US010013965B2

(12) United States Patent
Huang

(10) Patent No.: US 10,013,965 B2
(45) Date of Patent: Jul. 3, 2018

(54) CALIBRATION SYSTEM FOR ACTIVE NOISE CANCELLATION AND SPEAKER APPARATUS

(71) Applicant: C-MEDIA ELECTRONICS INC., Taipei (TW)

(72) Inventor: Chih-Ying Huang, Taipei (TW)

(73) Assignee: C-MEDIA ELECTRONICS INC., Taipei (TW)

( * ) Notice: Subject to any disclaimer, the term of this patent is extended or adjusted under 35 U.S.C. 154(b) by 0 days.

(21) Appl. No.: 15/815,585

(22) Filed: Nov. 16, 2017

(65) Prior Publication Data

US 2018/0144736 A1 May 24, 2018

(30) Foreign Application Priority Data

Nov. 23, 2016 (TW) ..... 105138485 A

(51) Int. Cl.
*G10K 11/178* (2006.01)
*H04R 1/10* (2006.01)

(52) U.S. Cl.
CPC ..... *G10K 11/178* (2013.01); *G10K 11/1782* (2013.01); *G10K 11/1788* (2013.01); *H04R 1/1083* (2013.01); *G10K 2210/1081* (2013.01); *G10K 2210/3027* (2013.01); *G10K 2210/504* (2013.01); *H04R 2460/01* (2013.01)

(58) Field of Classification Search
CPC ..... G10K 11/1788; G10K 2210/3055; G10K 2210/1282; G10K 2210/3027; G10K 2210/128; G10K 2210/3221; G10K 2210/3053; G10K 2210/503; G10K 2210/506
See application file for complete search history.

(56) References Cited

U.S. PATENT DOCUMENTS 9,100,747 B2 * 8/2015 Murata ..... H04R 1/1083
9,824,678 B1 * 11/2017 Ou ..... G10K 11/178
2005/0207585 A1 * 9/2005 Christoph ..... G10K 11/178 381/71.11

(Continued)

FOREIGN PATENT DOCUMENTS

CN 205081952 U 3/2016
EP 2629289 A1 * 8/2013 ..... G10K 11/178
TW 423210 2/2001

*Primary Examiner* — Mohammad Islam
(74) *Attorney, Agent, or Firm* — Li & Cai Intellectual Property (USA) Office

(57) ABSTRACT

The disclosure is related to a calibration system for active noise cancellation and a speaker apparatus. The calibration system receives the signals with feedforward control or feedback control active noise cancellation. A gain adjustment element is used to adjust a gain of the signals, and a path selection switch is used to switch connection to a first operational amplifier or to a second operational amplifier. In addition to driving signals, the operational amplifier is also used to adjust a phase of the output signals. The calibration system is able to balance the gain of the signals with active noise cancellation and adjust the phase of signals of a left-channel circuit and a right-channel circuit through gain-phase adjustment. The related speaker apparatus is such as an earphone with the feedforward ANC control circuit, the feedback ANC control circuit, or a hybrid ANC circuit.

20 Claims, 6 Drawing Sheets

(56) References Cited

U.S. PATENT DOCUMENTS

| | | | | |
|---|---|---|---|---|
| 2009/0086990 | A1* | 4/2009 | Christoph | H04R 3/04 381/71.12 |
| 2010/0272283 | A1* | 10/2010 | Carreras | G10K 11/178 381/71.6 |
| 2011/0206214 | A1* | 8/2011 | Christoph | G10K 11/1784 381/71.6 |
| 2012/0093344 | A1* | 4/2012 | Sun | H04R 3/005 381/122 |
| 2015/0010164 | A1* | 1/2015 | Christoph | G10K 11/178 381/71.6 |
| 2016/0029124 | A1* | 1/2016 | Paranjpe | H04M 9/082 381/71.14 |
| 2016/0300563 | A1* | 10/2016 | Park | G10K 11/17853 |
| 2017/0077906 | A1* | 3/2017 | Argyropoulos | H03H 21/0012 |
| 2017/0178617 | A1* | 6/2017 | Christoph | G10K 11/1786 |
| 2017/0287462 | A1* | 10/2017 | Christoph | G10K 11/1788 |
| 2017/0301336 | A1* | 10/2017 | Kumar | G10K 11/178 |

* cited by examiner

CALIBRATION SYSTEM FOR ACTIVE NOISE CANCELLATION AND SPEAKER APPARATUS

BACKGROUND OF THE INVENTION

1. Field of the Invention

The present invention is generally related to a calibration circuit of active noise cancellation, and in particular to a calibration system adapted to a hybrid ANC circuits, and a speaker apparatus thereof.

2. Description of Related Art

A conventional ANC (Active Noise Cancellation) headset utilizes an audio-receiving unit to receive external noise, and an internal signal processing system of the ANC headset speakers generate the same frequency of the noise signals with a specific amplitude and phase to reduce the external noise. For example, a process in cooperation with software and hardware of the headset is operated to generate the signals with inverting phase but the same amplitude and frequency for nullifying the external noise. The process reaches the purpose of noise reduction.

FIG. 1 describes an operating principle of a system with active noise cancellation. A microphone 10 is used to receive ambient noise. An active filter 12 is used to filter the noise for rendering suitable frequency responses that include the responses of amplitude and phase. The suitable responses cause the output signals of a headset speaker 14 to be inverted as compared to its original signals. The inverted noise outputted by the headset speaker 14 can nullify the original noise received by the microphone 10 inside a listener's earmuff 16. Therefore, the technique of the active noise cancellation can greatly reduce the external noise heard by the listener.

The ANC system can be categorized into two types: those with a feedforward control structure and those with a feedback control structure. Since an instability problem exists in the conventional feedback control ANC system, during a manufacturing process thereof, much time is devoted in selecting appropriate frequency response therefor and in tuning a gain/phase of a controller of the system. Though the feedforward control ANC system may not have an instability problem, time must still be spent on tuning up for reaching a desired performance.

A conventional hybrid type ANC system that possesses the advantages of both the feedforward control type and the feedback control type ANC systems has been developed in the prior art. However, in order to obtain a better performance of noise reduction, the hybrid type ANC system adopts four microphones in one device that increases the complexity of a control circuit, thus raising an overall cost of circuit design and electronic components.

FIG. 2 schematically shows a headset with active noise cancellation according to the conventional technology. An earmuff 200 covering a human ear 20 is shown. Two microphones are respectively disposed inside and outside the headset. A speaker 203 is disposed inside the earphone cover 200. The inside digital microphone 205 is used to receive error signals which operating in feedback ANC mode. This microphone 205 includes a sigma-delta converter that is able to generate digital signals to a digital signal processor 201. The outside digital microphone 207 is used to receive reference signals which operate in feedforward ANC mode. The microphone 207 includes another sigma-delta converter that is also used to convert the signals into digital signals, and transmit the signals to the digital signal processor 201.

The technique of active noise cancellation shown above allows the headset to receive reference signals through the outside digital microphone 207, and to receive noise, e.g. the error signals, inside the earmuff 200 using the inside digital microphone 205. The error signals are then fed back to the digital signal processor 201. The digital signal processor 201 can automatically tune up parameters of a digital filter. The speaker 203 inside the headset includes an internal amplifier, such as a class-D amplifier, that is used to receive the digital signals generated by the digital signal processor 201. The digital signals are then converted to audio signals. One of the objectives of the mechanism of active noise cancellation is to suppress the noise transmitted to the human ear to a minimum.

FIG. 3 shows a basic circuit of the conventional active noise cancellation technique. While this example schematically shows a mono channel, e.g. a left-channel, this channel is not significantly different from the other channel.

The diagram shows ANC circuit blocks of a left channel of a headset. The audio signals are transmitted to the headset through a left-channel sound source interface 31. A digital controller 35 controls a gain for the left-channel sound source interface 31. A gain control amplifier 33 then adjusts the gain. In the meantime, a left-channel microphone 37 receives the ambient noise. A microphone gain control amplifier 38 adjusts a gain of the ambient noise, and an ANC filer 39 receives the ambient noise with suitable frequency response. One of the major objectives in the process is to obtain the signals with inverting phase and the same amplitude on speaker output compared with the received noise inside the earmuff. The noise other than the audio signals can be suppressed when both the adjusted noise and the signals received from an audio source are inputted to a mixer 310. A left-channel driving circuit 311 then drives a headset monomer to output the signals.

The aforementioned framework of the conventional ANC headset requires an independent microphone amplifier, e.g. the gain control amplifier 38 that is to fine tune and to calibrate the gain of the microphone. The amplified signals are then serially inputted to an ANC filter 39 and another post mixer 39. Therefore, a hybrid system having both the feedforward control type and the feedback control type ANC circuits requires independent amplifiers and gain control circuits for the external microphone and the internal microphone respectively, so that a structure thereof cannot be simplified effectively.

Further, the conventional ANC system for the headset includes a left-channel and a right-channel gain-balance calibration circuits. The calibration circuit is disposed at a front end of the system. All of the audio input, the feedforward control circuit, and the feedback control circuit require their own independent amplifiers and gain-control circuits since the calibration circuit cannot be shared with other circuits. Therefore, an overall circuit layout requires a larger area that increases the cost of materials in production.

SUMMARY OF THE INVENTION

In contrast to the conventional ANC (active noise cancellation) system that requires independent amplifiers and gain control circuits for its audio input, a feedforward control circuit and the feedback control circuit, an ANC calibration system that improves on the conventional technology and simplifies the circuit structure thereof is provided in the disclosure.

According to an embodiment of the system, the ANC calibration system includes a control unit that is able to generate the ANC-controlled signals. The system uses a gain adjustment element to adjust a gain for the signals through active noise cancellation, e.g. the ANC-controlled signals. The system includes a first operational amplifier and a second operational amplifier. The first operational amplifier operates for filtering microphone signals, and adjusts phase and gain of the microphone signals. The second operational amplifier connects to an output terminal of the first operational amplifier. The second operational amplifier drives a speaker monomer.

In an application of the present disclosure, the ANC calibration system can be applied to a speaker apparatus with the function of active noise cancellation. The second operational amplifier can drive larger current for driving the speaker monomer. The speaker apparatus is such as a headset with a feedforward ANC control circuit, a feedback ANC control circuit, or a hybrid ANC control circuit having both the feedforward ANC control circuit and the feedback ANC control circuit.

In one embodiment, the feedforward ANC filter connects to a feedforward-type microphone which is used to receive ambient sound outside the speaker apparatus. The feedback ANC filter connects to a feedback-type microphone inside the speaker apparatus.

The left-channel circuit or the right-channel circuit of the calibration system includes a monitoring gain adjustment unit that can connect to the feedforward-type microphone and receive the external sound received by the feedforward-type microphone. While the first operational amplifier is turned off, an amplifier circuit is included to amplify a suitable gain for the feedforward-type microphone. Then, the monitoring gain adjustment unit allows the speaker apparatus to function in a monitoring mode when the signals are mixed at a post stage of the speaker apparatus.

DETAILED DESCRIPTION OF THE PREFERRED EMBODIMENTS

The present invention will now be described more fully with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art.

An active noise cancellation (abbreviated to 'ANC') system adapted to an ANC headset can be a feedforward mode or a feedback mode control circuit. A hybrid ANC mode is configured for integrating the advantages of the feedforward mode and the feedback mode control circuits. In the present disclosure in accordance with the present invention, a calibration system with ANC function is provided. The calibration system applies a scenario of a hybrid ANC system that provides a simplified circuitry. In one embodiment, the hybrid ANC system with a minimum serial series can implement ANC adapted to the calibration system, which not only reduces the circuit cost but also achieves balanced calibration of the gains in the left and right channels. The calibration system accordingly performs an automatic digitalized calibration. This automatic calibration system is able to flexibly adjust the gain of every filter therein. The amplifier of the calibration circuit is combined with phase 0 or 180 degree turning options, and therefore the calibration is convenient to use with the ANC filter in any order of the serial series as well as the inverting or non-inverting microphones and not need to insert extra inverting amplifiers.

Figure 4:
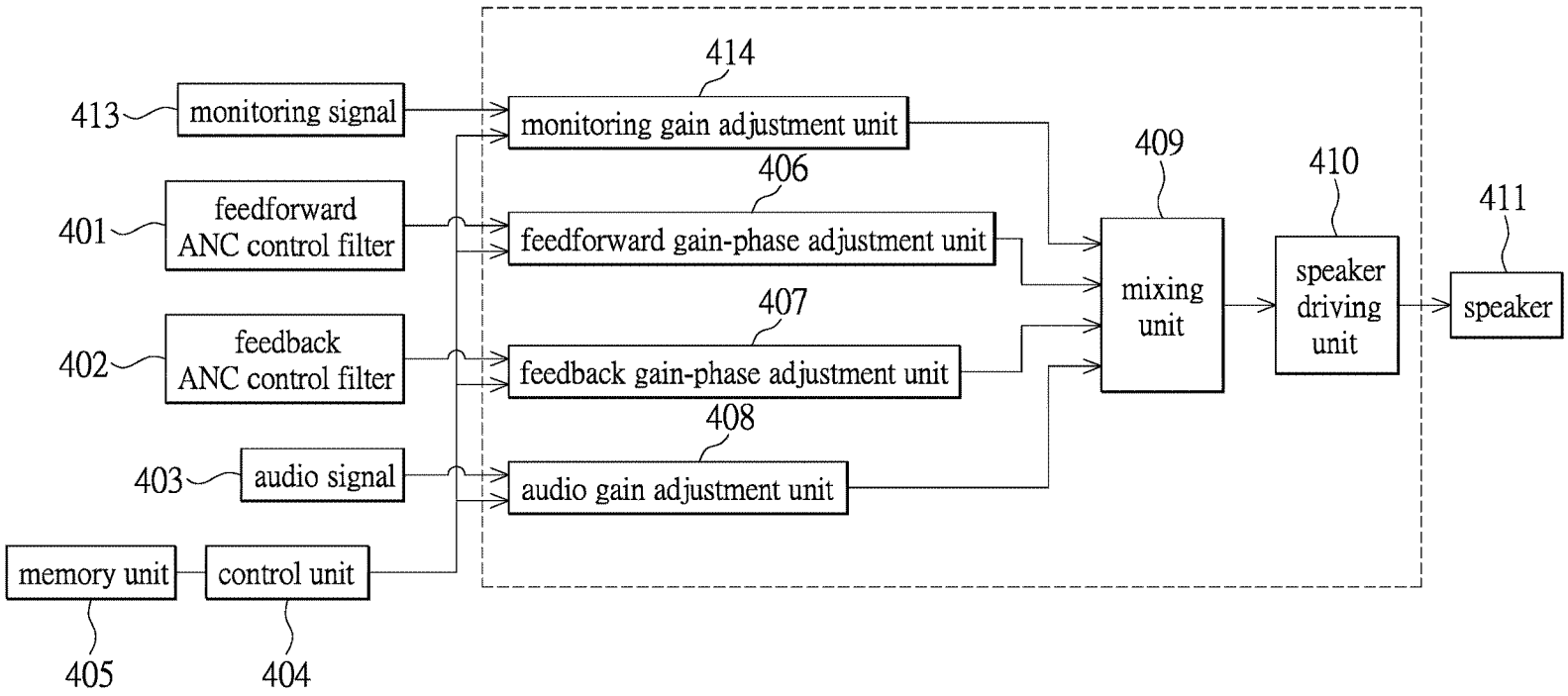
FIG. 4 shows a schematic diagram depicting an ANC calibration system in one embodiment of the present invention.

It is worth noting that the ANC calibration system in the disclosure is capable of balancing the gains of both the left-channel gain and the right-channel gain of a speaker apparatus due to the inaccuracy of its microphone device, amplifier circuits, etc. Therefore, the calibration system is able to avoid an uncomfortable listening experience due to the imbalanced volume of the left and right channels of the speaker apparatus. According to one of the embodiments of the ANC calibration system that applies a hybrid-type ANC system, the signal calibration can be applied to the audio signals of a Line-in input. The audio signals can be an MP3 device or other audio players, in which the gain balance over the Line-in input to the left and right channels of the speaker apparatus can be adjusted. Further, the gain balance adjustment can be applied to an in-earmuff microphone to the left and right channels of the speaker apparatus as a feedback-type ANC is performed upon a microphone inside the earmuff. The gain balance adjustment can also be applied to the microphone outside the earmuff to the left and right channels of the speaker apparatus while a feedforward-type ANC is performed upon the microphone outside the earmuff. The relevant embodiment is shown in FIG. 4.

Figure 1:
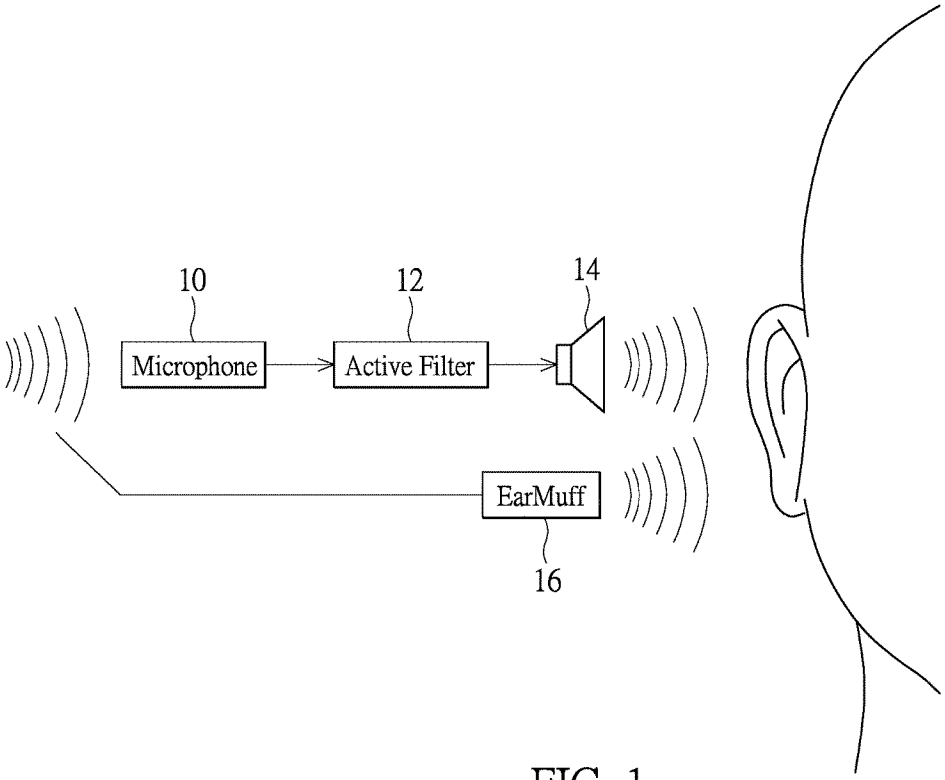
FIG. 1 Related Art
FIG. 1 schematically shows a conventional ambient ANC system.
Figure 2:
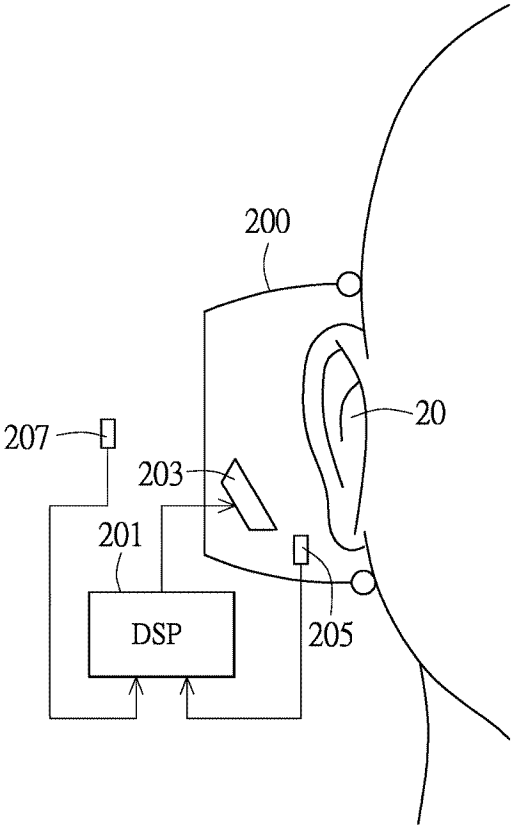
FIG. 2 Related Art
FIG. 2 shows a schematic diagram depicting a conventional ANC headset.
Figure 3:
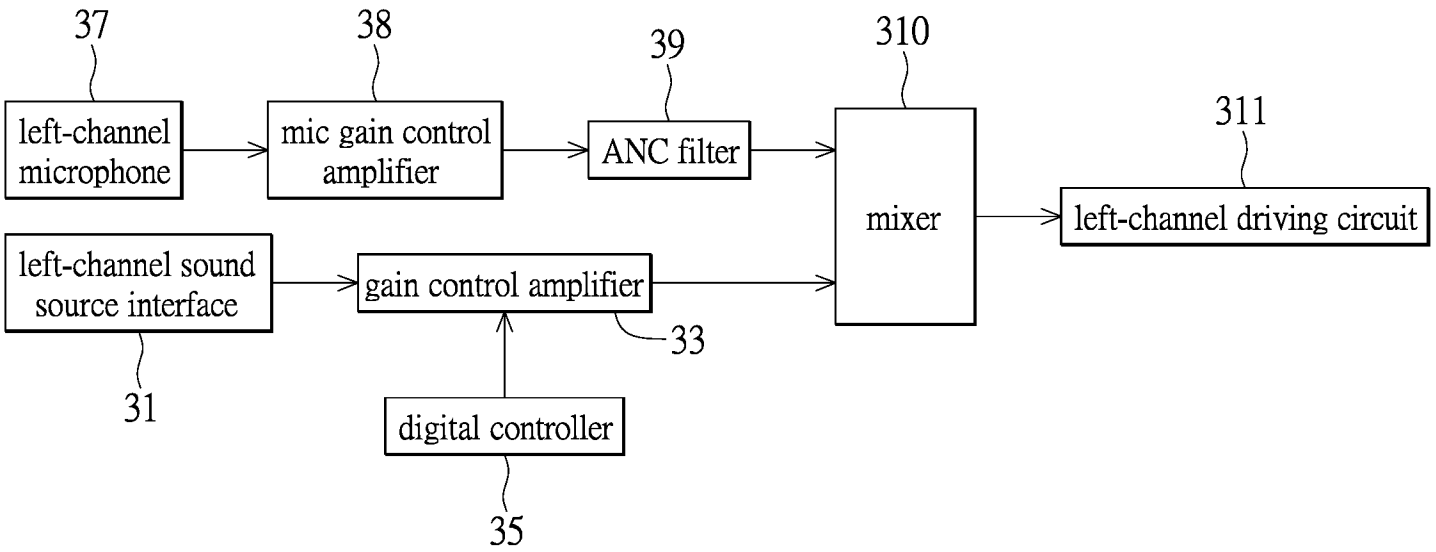
FIG. 3 Related Art
FIG. 3 shows a basic circuit diagram of a conventional ANC circuit.

The ANC calibration system is exemplarily implemented by using the ANC circuit described in FIG. 3. The calibration system incorporates an operational aspect of an inverting operational amplifier that mixes and shares the same one or more output-stage operational amplifiers. A calibration circuit is particularly formed at the output stage of the ANC circuit. According to one embodiment of the calibration system shown in FIG. 4, rather than the conventional technique in which the gain of the variable resistance is manually adjusted for balancing the gains in the channels of the speaker, the calibration system provides an automatic control circuit. The automatic control circuit not only supports gain calibration of the left and right channels of the speaker, but also adjusts the operating phase to 0 degree or 180 degree in each path. The path is such as the shown path of feedforward control, feedback control or the audio source. The adjustable phase from 0 degrees to 180 degrees, and vice versa, allows the system to support normal or inverting phase microphone monomer. Further, the feature of the adjustable phase allows any order of the filter applied to the operational amplifier to conduct non-inverting or inverting amplification. Further, the output of circuit can conveniently be inverted again according to practical requirements.

In the present embodiment, a feedforward ANC filter 401 is electrically connected with a feedforward gain-phase adjustment unit 406. The feedforward gain-phase adjustment unit 406 can be implemented by a gain-adjustment element and a path selection switch connected with the operational amplifier. A feedback ANC filter 402 is electrically connected with a feedback gain-phase adjustment unit 407. The feedback gain-phase adjustment unit 407 can also be implemented by the gain adjustment element and the path selection switch. The signal source is such as an audio signal 403 that is connected to an audio gain adjustment unit 408.

In the calibration system, the calibration value of gain can be stored in a memory unit 405. A control unit 404 controls the inputting of the calibration value in the memory unit 405 to every gain-phase adjustment unit. The memory unit 405 is a non-volatile memory that stores the calibration value. When the system is booted again, the calibration value in the memory from the last operation can be imported to the gain-phase adjustment unit in each path. This scheme allows the left channel and right channel of the speaker apparatus to operate with the corrected value.

The control unit 404 allows the feedforward gain-phase adjustment unit 406, the feedback gain-phase adjustment unit 407, and the audio gain adjustment unit 408 to have 0 degree or 180 degree phase adjustment. This scheme makes the output stage filter more flexible.

The general ANC system deals with the low-frequency noise below 1 kHz. The operational amplifier in the circuit performs low frequency filtering. However, when the operational amplifier acts as a filter with various filtering orders, the low-frequency signals can be outputted with non-inverting phase or inverting phase in every channel. It should be noted that the microphone can be an inverting (180 degree) microphone or a non-inverting (0 degree) microphone accordingly. While a mixing unit 409 is applied to the calibration system, the calibration system renders an option of 0-degree phase or 180-degree phase at the output stage. Therefore, the scenario of option allows the designer to compensate the phase at the rear end without consideration of the output phase of the low-frequency signals at the front end, e.g. the filter, due to the various orders.

The calibration system provides a function of inverting/non-inverting phase adjustment at an output stage of the ANC-enabled speaker apparatus, e.g. a headset, for compensating the phases required by various devices. This arrangement allows the circuit designer to design the product more conveniently and flexibly.

Furthermore, in one further embodiment, the system provides a monitoring function in its calibration circuit. This function uses the external feedforward-type microphone that is originally designed to receive noise, e.g. the monitoring signal 413, to receive environment sound. It is generally not necessary to process the received sound. The monitoring signal 413 is received by a monitoring gain adjustment unit 414. Through a suitable gain adjustment or the gain value stored in the memory unit 405 controlled by the control unit 404, the gain for the monitoring gain adjustment unit 414 can be decided.

When the audio signals 403 are imported to the circuit, the audio gain adjustment unit 408 receives the audio signals 403. The control unit 404 inputs the gain value stored in the memory unit 405, by which the gain of the audio signals 403 is adjusted. Once the control unit 404 sets up the gain and phase, the audio gain adjustment unit 408 adjusts the gain of the audio signals 403, and simultaneously compensates the imbalanced gain for the left and right channels over the audio paths. After that, the mixing unit 409 performs mixing upon the signals adjusted by each path's gain-phase adjustment unit 414, 406, 407, or 408. The mixed signals are then transmitted to the speaker driving unit 410 that drives a speaker 411 to output the audio signals. It should be noted that the speaker driving unit 410 is capable of high driving current for driving the speaker 411 much like a coil-type speaker.

According to the embodiment described above, the calibration system is applicable to a single-ANC mechanism, for example, to a headset that merely adopts a feedforward ANC control circuit, or a feedback ANC control circuit. The calibration system may also be applicable to the control circuit with a hybrid type ANC that integrates the feedforward ANC control circuit and the feedback ANC control circuit. The mentioned memory unit 405 is such as a multi-rewritable non-volatile memory. The gain value stored in the memory can be dynamically adjusted. The calibration values with the adjusted gains respectively for the left-channel and the right-channel are written to the non-volatile memory. The record thereof allows the calibration system to perform calibration automatically. Thus, the calibration system achieves elimination of manpower and substantial increase in production efficiency.

Figure 5:
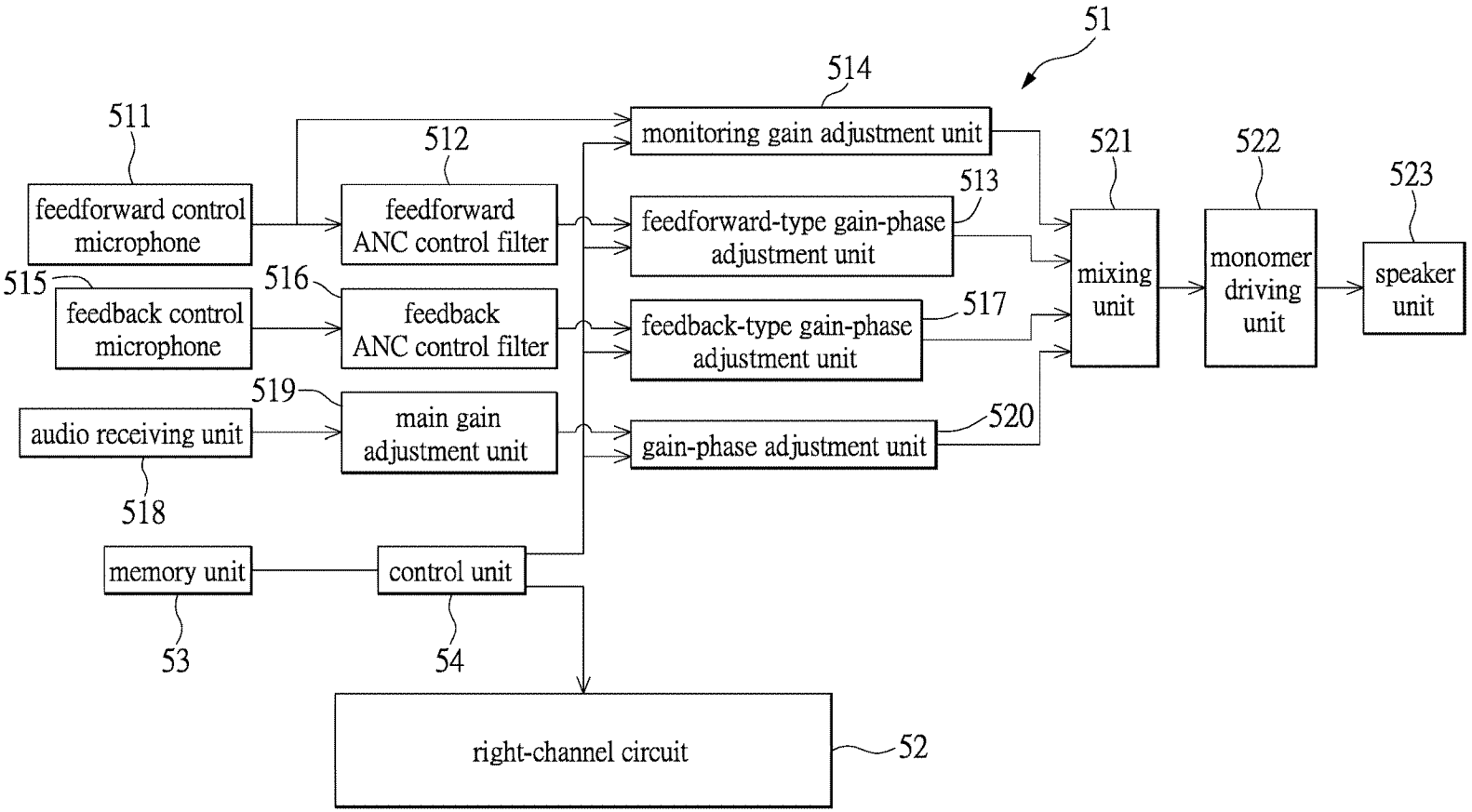
FIG. 5 shows a circuit block diagram depicting a speaker apparatus with ANC calibration system in one embodiment of the present invention.

Reference is made to FIG. 5 depicting a circuit block diagram describing a calibration system adapted to a speaker apparatus according to one embodiment of the present invention. The ANC circuit for the speaker apparatus is mainly for a left-channel circuit 51 that is substantially the same with the ANC circuit for a right-channel circuit 52. The calibration system can be applied to the feedforward ANC control circuit, the feedback ANC control circuit, or the hybrid type ANC control circuit.

The speaker apparatus is such as a headset device. The ANC control circuit is mainly implemented by a left-channel side feedforward ANC filter 512 and feedback ANC filter 516, and a right-channel side feedforward ANC filter and feedback ANC filter (omitted from the diagram). The feedforward ANC filter 512 and the feedback ANC filter 516 uses at least one operational amplifier.

According to the schematic diagram of the left-channel circuit 51, a feedforward-type microphone 511 is used to receive environmental sound outside the speaker apparatus, and the environmental sound is treated as noise. The feedforward ANC filter 512 then processes the environmental sound, and a feedforward-type gain-phase adjustment unit 513 performs gain and phase adjustment. Simultaneously, a monitoring gain adjustment unit 514 receives the sound received by the feedforward-type microphone 511, and generates monitored sound.

Over the left-channel feedback ANC circuit, a feedback-type microphone 515 is included. The feedback-type microphone 515 is such as an ANC microphone inside an earmuff of the headset. The feedback ANC filter 516 performs filtering upon the received sound, and the feedback-type gain-phase adjustment unit 517 performs gain and phase adjustment as receiving the sound.

A main gain adjustment unit 519 adjusts a major gain of the audio signals received from an audio receiving unit 518. A gain-phase adjustment unit 520 is used to fine tune the gain and the phase of the audio signals. The audio signals processed by the monitoring gain adjustment unit 514, the feedforward-type gain-phase adjustment unit 513, the feedback-type gain-phase adjustment unit 517, and the gain-phase adjustment unit 520 are mixed by a mixing unit 521. The mixed signals are transmitted to a monomer driving unit 522 that drives a speaker unit 523 to play the sound through the active noise cancellation process.

Further, a control unit 54 is provided in the calibration system. The control unit 54 is electrically connected with the aforementioned monitoring gain adjustment unit 514, feedforward-type gain-phase adjustment unit 513, feedback-type gain-phase adjustment unit 517, and gain-phase adjustment unit 520 of the left-channel circuit 51. The control unit 54 is also electrically connected to the similar circuit units such as a monitoring gain adjustment unit 514, a feedforward-type gain-phase adjustment unit 513, a feedback-type gain-phase adjustment unit 517, and a gain-phase adjustment unit 520 of the right-channel circuit 52.

The control unit 54 is a control circuit for controlling the operation of the units. The control unit 54 obtains a calibration value from the memory unit 53. When the system boots, the control unit 54 downloads the calibration value to all adjustment units and keeps the system operating. The gain adjustment allows the system to fine tune the balance between the left channel and the right channel over the path from the microphones 511, 515 to the speaker unit 523. Further, the gain adjustment mechanism also allows the user to switch the gains in different circumstances. A high gain and a low gain can respectively represent different effects of noise cancellation. A designer can apply the different gains to switch the levels of noise cancellation in different circumstances. It should be noted that the calibration value stored in the memory unit 53 can include a value of phase adjustment.

When the paths to the left and right channels are processed by the gain and phase adjustment, a final mixer such as the mixing unit 521 of the left channel can perform mixing thereon. The monomer driving unit 522 at the output stage in the channel, e.g. the left channel, drives the speaker unit 523 to output the mixed sound.

Taking the left-channel circuit 51 as an example; the feedforward ANC filter 512 receives the external sound from the feedforward-type microphone 511. The feedforward ANC filter 512 acts as a low-pass filter that is used to filter the signals received by the feedforward-type microphone 512. The feedforward ANC filter 512 is designed with suitable gain and phase response. The gain and phase of the filter can have a decisive effect on the ANC system, and especially to the quantity of the system's noise. Further, the high frequency noise should be essentially attenuated by this filter because it may induce high frequency noise to speaker in ANC system. Similarly, the feedback ANC filter 516 also acts as a filter form the feedback-type microphone 515 in the left channel. The gain and phase adjustment of the feedback ANC filter 516 essentially impacts the performance of the ANC system.

Still further, as to the left-channel circuit 51, the main gain adjustment unit 519 receives audio signals from the audio receiving unit 518. The audio receiving unit 518 is such as a Line-In interface of a speaker apparatus. The main gain adjustment unit 519 acts as a volume adjuster for this Line-In interface. A user can adjust the main volume by this main gain adjustment unit 519.

In the above embodiment, the audio signals received by the feedforward-type microphone 511 are fed to the feedforward-type gain-phase adjustment unit 513 through the feedforward ANC filter 512. The feedforward-type gain-phase adjustment unit 513 can fine tune the gain for the audio signals by, for example, using a digitally-controlled gain stage. The feedforward-type gain-phase adjustment unit 513 also uses the calibration value as the gain and phase parameters from the memory unit 53 through control unit 54. The calibration value is a suitable gain that is provided for solving the imbalanced gain over the feedforward ANC paths of the left and right channels. The control unit 54 uses the calibration value to control the gain value of the feedforward-type gain-phase adjustment unit 513, namely, to control the gain values for both the feedforward-type gain-phase adjustment units of the left-channel circuit 51 and the right-channel circuit 52 respectively. Therefore, the calibration system resolves the imbalanced gains of the two channels in the ANC circuit.

The gain balancing mechanism is applied to both the left channel and the right channel over the feedback ANC path. As to the left-channel circuit 51, the audio signals received by the feedback-type microphone 515 are fed to the feedback-type gain-phase adjustment unit 517 through the feedback ANC filter 516. The feedback-type gain-phase adjustment unit 517 fine tunes the gain of the audio signals. The control unit 54 uses the calibration value as the gain and phase parameters from the memory unit 53 through control unit 54. The control unit 54 controls a gain value for the feedback-type gain-phase adjustment unit 517 of the left-channel circuit 51 in the current example, but also controls the gain value for the feedback-type gain-phase adjustment unit of the right-channel circuit. The feedback-type gain-phase adjustment unit renders a suitable gain for balancing the gain in both the left and right channels.

Further, as to the left-channel circuit 51, the audio signals are received by the audio receiving unit 518. The gain of audio signals is adjusted by the main gain adjustment unit 519. The adjusted gain is then fine-tuned by the gain-phase adjustment unit 520. The control unit 54 in another aspect may also be used to control the gain value. The control unit 54 stores the calibration value of the gain to the memory unit 53 in the calibration process, and allows the gain-phase adjustment unit 520 to use the calibration value for calibrating the imbalanced gain between the left channel and the right channel.

As to the left-channel circuit 51, the monitoring gain adjustment unit 514 is controlled by the control unit 54. The monitoring gain adjustment unit 514 is a digitally controllable gain adjustment unit. The monitoring gain adjustment unit 514 monitors the external sound outside the earmuff of the headset. One of the objectives of the monitoring gain adjustment unit 514 is to monitor the external sound outside the earmuff when the user listens to the sound using the headset. The volume level of the sound to be monitored can be pre-stored to the memory unit 53.

The mixing unit 521 is such as a mixing adder that sums up the signals generated by the monitoring gain adjustment unit 514, the feedforward-type gain-phase adjustment unit 513, the feedback-type gain-phase adjustment unit 517 and the gain-phase adjustment unit 520 of the left-channel circuit 51. The summed signals are fed to a headset driving stage, e.g. the monomer driving unit 522. The monomer driving unit 522 drives the speaker unit 523 to output the sound. The aforementioned scenario is also applied to the right-channel circuit 52. The signals in the right-channel circuit 52 are calibrated through the same calibration mechanism applied to the left-channel circuit 51. The calibrated audio signals are then added and fed to the mixing unit of the right-channel circuit 52. The monomer driving unit of the right-channel circuit 52 then drives the speaker to output the right-channel sound.

Figure 6:
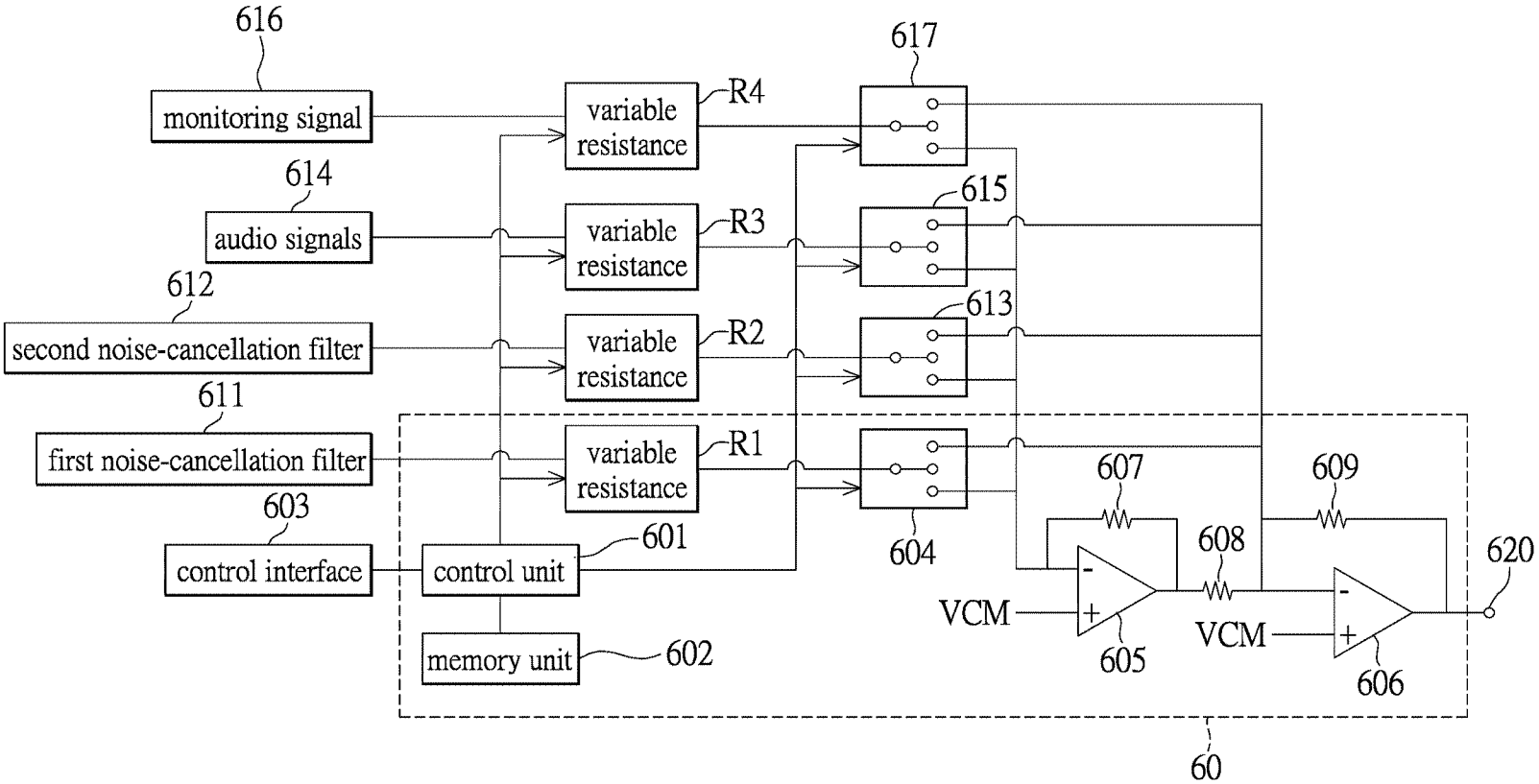
FIG. 6 shows another schematic diagram depicting the ANC calibration system according to one embodiment of the present invention.

Reference is next made to FIG. 6, showing a circuit block diagram depicting the ANC calibration system in one embodiment of the present invention. As an ANC calibration system is installed to the left-channel circuit or the right-channel circuit, a calibration module 60 shown in FIG. 6 is an elementary part of the calibration system. The calibration module 60 includes a control unit 601 connects to control interface 603 and memory unit 602 that performs digital control to variable resistance R1, R2, R3, and R4, and a memory unit 602 that stores calibration value. A control interface 603 is provided for receiving the control signals that are used to drive the control unit 601 to control a gain adjustment element. The gain adjustment element is used to control the gain of the signals over every path. The gain adjustment element is exemplarily implemented by the variable resistances R1, R2, R3 and/or R4, and the corresponding path selection switches 604, 613, 615 and/or 617.

The calibration module 60 acts as an elementary circuit for implementing the calibration system of the present invention. The calibration module 60 includes a controllable variable resistance R1 and a first path selection switch 604. Further, two operational amplifiers such as a first operational amplifier 605 and a second operational amplifier 606 may be included as a part of the gain adjustment element. Several resistances 607, 608 and 609 are disposed on the circuit of the operational amplifier. The first operational amplifier 605 and the second operational amplifier 606 are respectively disposed with two input terminals and an output terminal. The switch 604 is a 1-to-2 analog switching device which turns on the path is decided by control unit 601. The signal from variable resistance R1 can connect to a negative input of operational amplifier 605 or a negative input of operational amplifier 606 by the switch 604.

The first operational amplifier 605 includes two input terminals and an output terminal. The two input terminals are respectively connected to one path selection switch 604 and the reference voltage VCM. The input terminal of the second operational amplifier 606 is electrically connected to an output terminal of the first operational amplifier 605 through resistance 608. The two input terminals are respectively connected to a path selection switch 604, and another reference voltage VCM.

Further, in one aspect of the invention, the first operational amplifier 605 and the second operational amplifier 606 are installed at a signal output terminal of one of the channels of the ANC calibration system. The signal output terminal is such as a speaker monomer 620. The calibration module 60 is a cascade amplifier constructed by two inverting operational amplifier 605 and 606. The calibration module 60 integrates the circuits of mixer, gain control, and the inverting/non-inverting phase selector.

In the system, the first noise-cancellation filter 611 is electrically connected with a variable resistance R1. The variable resistance R1 is controlled by the control unit 601 which resistance is varied by the control bits. The variable resistance R1 is used to adjust the gain of a path of the calibration module. The variable resistance R1 is fed to the first path selection switch 604 that is controlled by the control unit 601. The control unit 601 controls the path of the control signal to pass through the first operational amplifier 605 or the second operational amplifier 606, so as to adjust the phase 0 or 180 degree of the calibration module. For the single noise cancellation filter case (without multiple signal sources), if the phase of 180-degree is selected, the output terminal of the operational amplifier 605 must set to be high impedance and it may be turned off. If phase of 0-degree is selected, operational amplifiers 605 and operational amplifier 606 must be turned on.

In the current embodiment, the first operational amplifier 605 is installed near a front end of the calibration system for inverting the received signals. The first operational amplifier 605 exemplarily acts as an inverting circuit that inverts the signals with a 180-degree phase shift. The resistance 607 operates as an output feedback of the first operational amplifier 605. In one embodiment, the first operational amplifier 605 can be configured to be an amplifier to drive a smaller current without heavy load.

The first operational amplifier 605 is connected with the second operational amplifier 606 through the resistance 608. The second operational amplifier 606 is installed near an output end of the speaker monomer 620. The second operational amplifier 606 acts as an inverting circuit. The resistance 609 operates as another output feedback of the second operational amplifier 606. The second operational amplifier 606 renders a larger current that is used to drive the speaker monomer outputting the sound.

The phase adjustment is performed by the first path selection switch 604 that controls a signaling path to pass through the first operational amplifier 605 or the second operational amplifier 606. The gain adjustment is achieved by different control bits from control unit 601 to variable resistance R1.

In an exemplary example, the first path selection switch 604 is controlled to connect to an upper line that is directed to the second operational amplifier 606. The second operational amplifier 606 not only drives the output, but also performs once 180-degree phase adjustment. In this case, to prevent signal leakage to the operational amplifier 605, the operational amplifier 605 must set to be high output impedance. Alternatively, the first path selection switch 604 is controlled to connect to a lower line that is directed to both the first operational amplifier 605 and the second operational amplifier 606. The first operational amplifier 605 and the second operational amplifier 606 perform 180-degree phase adjustments twice, namely, back to the 0-degree phase.

Therefore, the path selection made by the first operational amplifier 605 and the second operational amplifier 606 will determine the phase of output signals, such as the 0-degree phase or 180-degree phase. It should be noted that the signaling path is generally toward the output through the second operational amplifier 606 that is used to drive the larger current.

Since the calibration module is based on inverting operational amplifier, it is actually a very flexible mixer. That is, the system can have multiple signal sources. For example, the gain of the signals through ANC by the second noise-cancellation filter 612 can be adjusted by the variable resistance R2. The signals with adjusted gain are fed to the second path selection switch 613. The second path selection switch 613 is controlled by the control unit 601 so as to determine if the signaling path is passing through the first operational amplifier 605 or second operational amplifier 606. The control bits to switch 613 determine the phase of the output signals as demands. In one embodiment, the first noise-cancellation filter 611 and the second noise-cancellation filter 612 are respectively the feedforward ANC filter and the feedback ANC filter.

The gain of the audio signals 614 is adjusted by the variable resistance R3. The signals with the adjusted gain are fed to the third path selection switch 615, by which the system determines if the signaling path passes through the first operational amplifier 605, or directly to the second operational amplifier 606. Therefore, the phase of the output signals can be controlled. In practice, it is not necessary for the phase of general audio signals 614 to be adjusted. In one further embodiment, the third path selection switch 615 can be omitted.

Furthermore, a gain for the monitoring signal 616 can be adjusted by the variable resistance R4. The monitoring signal 606 with the adjusted gain can be fed to the fourth path selection switch 617, by which the system determines if the signaling path passes through the first operational amplifier 605, or directly passes through the second operational amplifier 606. Therefore, the phase of the signals can be controlled. Similarly, it is not necessary for the gain of the general monitoring signal 616 to be adjusted, and the fourth path selection switch 617 can also be neglected in the present embodiment.

In an exemplary example, the first noise-cancellation filter 611 and the second noise-cancellation filter 612 are respectively the feedforward ANC filter and the feedback ANC filter. In the calibration system, the gain can be adjusted by the variable resistances R1 and/or R2, and the phase of signals can also be adjusted by the first path selection switch 604 and/or the second path selection switch 613. Therefore, the ANC calibration system can adjust the inverting/non-inverting phase of every filter, render the ANC filter to be in any stage, and also support the inverting or non-inverting microphone.

The above-mentioned variable resistances R1, R2, R3 and R4 are controlled by the control unit 601 that performs gain adjustment. The control unit 601 retrieves the calibration value of the gain from the memory unit 602. In response to the calibration value, the variable resistances R1, R2, R3 and R4 are adjusted for tuning the gain for each signaling path. The path selection switches 604, 613, 615 and 617 are controlled by the control unit 601. The control unit 601 retrieves the calibration value of the phase from the memory unit 602. The calibration value of phase corresponds to the switch status of every path selection switch. The selection of signaling path over the one or more operational amplifiers 605 and 606 determines the phase of signals over every path. The output impedance of the first operational amplifier 605 is decided by phase selection, if no any 0-degree phase is setting for any input signal source to the calibration module, the operational amplifier 605 must set to be high output impedance and may be turned off. If not at this case, the operational amplifier 605 must always be turned on.

The driving stage of the present invention is not limited to the above embodiments, and can be more flexibly adapted to various noise-reduction circuits. For example, it may not be necessary for the feedforward ANC control circuit and the feedback ANC control circuit may to output at the same phase, but can be in 0-degree or 180-degree phase individually.

Compared to the gain adjustment of the conventional feedforward ANC circuit or feedback ANC circuit, which requires a first stage of operational amplifier, the calibration system in accordance with the present disclosure does not install any amplifier over every signaling path for the purpose of gain adjustment. The calibration system merely requires the provision of the first and/or second operational amplifiers at the driving stage while it applies the principle of mixing performed by the operational amplifier. One of the features of the present disclosure is that the calibration system can effectively save hardware costs. Even though the inverting phases are chosen over all the signaling paths, the calibration system only uses one operational amplifier at the driving stage. The calibration module integrates a mixer, 0-degree or 180-degree phase shifter and gain adjustment for every individual signal path by using only two operational amplifiers, switches, resistors and digital controlled variable resistors, it greatly reduce the hardware area and current consumption. The calibration system supports both the inverting and the non-inverting microphones since it only focuses the phase adjustment.

Thus, the ANC calibration system is installed in an output end of a headset, so that the external microphone or the internal microphone of the headset needs not any independent amplifier. A same operational amplifier can be simultaneously used for the amplifier with gain correction, the mixer, and the driving stage of headset. The operational amplifier can selectively operate at once or twice phase adjustment that can reduce the order of serial series and the area of hardware, and optimize signal to noise ratio of the system.

It is intended that the specification and depicted embodiment be considered exemplary only, with a true scope of the invention being determined by the broad meaning of the following claims.

What is claimed is:

1. An ANC calibration system, comprising:

a noise-cancellation filter, providing suitable frequency response;

a gain adjustment element, electrically connected with the noise-cancellation filter, used to adjust gain after the noise-cancellation filter;

a path selection switch, electrically connected with the gain adjustment element;

a first operational amplifier, electrically connected with the path selection switch, used to drive signals and tune a phase of the signals;

a second operational amplifier, electrically connected with the path selection switch and an output terminal of the first operational amplifier, used to drive signals, tune a phase of the signals, and output the signals; and a control unit, electrically connected to the gain adjustment element and the path selection switch, used to control a gain of the gain adjustment element;

wherein, the path selection switch is used to switch a connection between the first operational amplifier and the second operational amplifier.

2. The system as recited in claim 1, wherein, when the path selection switch is switched to connect to the first operational amplifier, the phase of the signals generated by the noise-cancellation filter is twice tuned while the signals pass through the first operational amplifier and the second operational amplifier; when the path selection switch is switched to connect to the second operational amplifier, the phase of the signals generated by the noise-cancellation filter is once tuned while the signals pass through the second operational amplifier.

3. The system as recited in claim 1, wherein the noise-cancellation filter is a feedforward ANC filter or a feedback ANC filter.

4. The system as recited in claim 3, wherein, when the path selection switch is switched to connect to the first operational amplifier, the phase of the signals generated by the noise-cancellation filter is twice tuned while the signals pass through the first operational amplifier and the second operational amplifier; when the path selection switch is switched to connect to the second operational amplifier, the phase of the signals generated by the noise-cancellation filter is once tuned while the signals pass through the second operational amplifier.

5. The system as recited in claim 4, wherein, a 0-degree phase is outputted if twice phase adjustments are performed; a 180-degree phase is outputted if once phase adjustment is performed and the first operational amplifier is set to be high impedance.

6. The system as recited in claim 5, wherein the output terminal of the first operational amplifier or the output terminal of the second operational amplifier has a resistance operating as an output feedback.

7. The system as recited in claim 1, wherein the gain adjustment element is a variable resistance.

8. The system as recited in claim 7, wherein, when the path selection switch is switched to connect to the first operational amplifier, the phase of the signals generated by the noise-cancellation filter is twice tuned while the signals pass through the first operational amplifier and the second operational amplifier; when the path selection switch is switched to connect to the second operational amplifier, the phase of the signals generated by the noise-cancellation filter is once tuned while the signals pass through the second operational amplifier.

9. The system as recited in claim 8, wherein the ANC calibration system is adapted to a speaker apparatus with an ANC circuit, in which the second operational amplifier renders a larger current to drive a monomer of the speaker apparatus.

10. An ANC calibration system, adapted to a speaker apparatus, comprising:

one or more noise-cancellation filters providing suitable frequency response;

at least one gain adjustment element, in which every gain adjustment element corresponds to one noise-cancellation filter, used to control the gain for the signals;

at least one path selection switch, in which every path selection switch correspondingly connects to the gain adjustment element of one noise-cancellation filter;

a first operational amplifier having two input terminals and one output terminal, in which one of the input terminals is connected to the at least one path selection switch; and the first operational amplifier operates one phase adjustment;

a second operational amplifier having two input terminals and one output terminal, in which one of the input terminals is connected to the output terminal of the first operational amplifier, and the at least one path selection switch; the output terminal of the second operational amplifier connects to a signal output terminal; and the second operational amplifier operates one phase adjustment, and renders a larger current that is used to drive a monomer of the speaker apparatus;

a control unit, electrically connected to the at least one gain adjustment element and the at least one path selection switch, used to control a gain of the at least one gain adjustment element, and control the at least one path selection switch to switch to the first operational amplifier or the second operational amplifier;

wherein, when the control unit controls the at least one path selection switch to switch a connection to the first operational amplifier, two times of phase adjustment are performed; when the control unit controls the at least one path selection switch to switch the connection to the second operational amplifier, one time of phase adjustment is performed.

11. The system as recited in claim 10, wherein the noise-cancellation filter is a feedforward ANC filter or a feedback ANC filter.

12. The system as recited in claim 10, further comprising a memory unit that is used to record a calibration value of the ANC calibration system, the calibration value including a gain for every gain adjustment element, and a switch status of every path selection switch.

13. The system as recited in claim 10, wherein, an ANC circuit of the speaker apparatus includes a left-channel circuit and a right-channel circuit, and the noise-cancellation filter for both the left-channel circuit and the right-channel circuit is a feedforward ANC filter or a feedback ANC filter.

14. The system as recited in claim 13, wherein the feedforward or feedback ANC filter of the left-channel circuit is connected with the gain adjustment element and the path selection switch of the left-channel circuit; the feedforward or feedback ANC filter of the right-channel circuit is connected with the gain adjustment element and the path selection switch of the right-channel circuit; the gain of the signals and the phase of the signals outputted by the left-channel circuit and the right-channel circuit are balanced through gain adjustment and phase adjustment.

15. The system as recited in claim 14, wherein the feedforward ANC filter is connected to a feedforward-type microphone outside the speaker apparatus; the feedback ANC filter is connected to a feedback-type microphone inside the speaker apparatus.

16. The system as recited in claim 15, wherein the left-channel circuit or the right-channel circuit includes a monitoring gain adjustment unit that is connected to the feedforward-type microphone and used to receive external sound received by the feedforward-type microphone so as to generate the monitored sound.

17. The system as recited in claim 10, wherein, a 0-degree phase is outputted if twice phase adjustments are performed; a 180-degree phase is outputted if once phase adjustment is performed and the first operational amplifier is set to be high impedance.

18. The system as recited in claim 17, wherein the output terminal of the first operational amplifier or the output terminal of the second operational amplifier has a resistance for signal feedback.

19. A speaker apparatus, including an ANC calibration system as recited in claim 1.

20. The apparatus as recited in claim 19, wherein the speaker apparatus is a headset with a feedforward ANC control circuit, the headset with a feedback ANC control circuit, or the headset with a hybrid ANC circuit that integrates the feedforward ANC control circuit and the feedback ANC control circuit.

* * * * *